United States Patent [19]

Thome

[11] 4,398,700

[45] Aug. 16, 1983

[54] ANNEALING FURNACE WITH AN IMPROVED COOLING SECTION

[75] Inventor: William L. Thome, Toledo, Ohio

[73] Assignee: Midland-Ross Corporation, Cleveland, Ohio

[21] Appl. No.: 426,871

[22] Filed: Sep. 29, 1982

[51] Int. Cl.[3] ..... C21D 9/573

[52] U.S. Cl. ..... 266/111; 148/156; 432/59; 432/8; 34/231; 266/102

[58] Field of Search ..... 34/155, 156, 219, 222, 34/231; 432/59, 8; 266/108, 90, 111-113; 148/156

[56] References Cited

U.S. PATENT DOCUMENTS 2,726,458 12/1955 Vaughan ..... 34/155
3,787,171 1/1974 Cromp ..... 432/59
4,363,472 12/1982 Shimoyama et al. ..... 266/111

FOREIGN PATENT DOCUMENTS 46-16244 5/1971 Japan ..... 266/90

*Primary Examiner*—M. J. Andrews
*Assistant Examiner*—Christopher W. Brody
*Attorney, Agent, or Firm*—H. Duane Switzer

[57] ABSTRACT

The cooling section of an annealing furnace is described as having the capabilities of maintaining, increasing, or decreasing the temperature of a strip of metal as it passes through the section. Moreover, special means are provided for forming around the cooling device, used in the cooling of the gas impinged against the traveling strip of metal, a cold sink which traps and prevents the backflow of cooled gas through the cooling device into the section, thereby eliminating the formation in the section of undesirable cold spots which adversely affect temperature uniformity in the section.

13 Claims, 3 Drawing Figures

ANNEALING FURNACE WITH AN IMPROVED COOLING SECTION

BACKGROUND OF THE INVENTION

The invention relates broadly to the section of a furnace in which a continuous web, such as a strip of metal, is cooled and, in particular, to the gas jet cooling section of an annealing furnace that is used in the production of high strength steels.

In such annealing furnaces, a continuous strip of metal travels successively through separate heating and soaking sections before it enters the gas jet cooling section, so-called because the hot metal strip is cooled from a temperature of, for example, 1400° F. to 1000° F. by jets or streams of a special protective cooling gas which are impinged against the strip of metal as it moves in one or more directions through the gas jet cooling section. The cooling of the strip is relative in that the strip is at an extremely high temperature of 1000° F. as it exits the gas jet cooling section for subsequent quenching and reheating. The temperature of the cooling gas is an important factor and is dependent on, for example, the strip cooling required, the rate of strip production desired, and the volume of the cooling gas used.

Better, more uniform cooling is achieved by contacting the trip of metal with a large mass flow of gas at a temperature which approaches or more nearly equals the temperature to which the strip is desired to be cooled, rather than contacting the strip with a small mass flow of gas at a substantially lower temperature. Translated to the example indicated above, it is advantageous to cool the strip to 1000° F. by contacting the strip with a sufficiently large mass of cooling gas at a temperature of, for example, 900° F., rather than contacting the strip with a much smaller mass flow of cooling gas at a much lower temperature of, for example, 300° F. It can be appreciated from the above, that the cooling gas referred to in this application may be at temperatures which would be considered extremely high in other processes.

The invention is specifically designed to maintain more uniform temperatures within the gas jet cooling section of an annealing furnace by the elimination or substantial reduction of cold spots which occur in such sections and adversely affect the uniformity of the temperature conditioning of the strip of metal as it passes through this section of the furnace.

Briefly stated, the invention is in the cooling section of an annealing furnace, which section includes a vertically elongated chamber which is sealed from the ambient atmosphere and through which a continuous element, such as a strip or sheet of metal, is passed in one or more directions. Means are provided for impinging confronting streams of cooling gas against opposite sides of the element as it passes vertically through the chamber. Means disposed alongside the chamber in communicating relation with the chamber, are supplied for cooling gas removed from the chamber, prior to the reuse of the gas for impingement against the traveling element. Means are provided for eliminating the backflow of gas, cooled by the gas cooling means, into the chamber to create within the chamber, cold spots which affect the uniform treatment of the element, since the circulation of gas used to cool the element is what might be called, a continuous closed loop system, i.e. the gas impinged against the traveling element in the chamber is initially removed from the chamber, cooled, and then recirculated to the chamber for impingement against the element.

DESCRIPTION OF THE DRAWING

The following description of the invention will be better understood by having reference to the accompanying drawing, wherein.

ENVIRONMENT OF THE INVENTION

Figure 1:
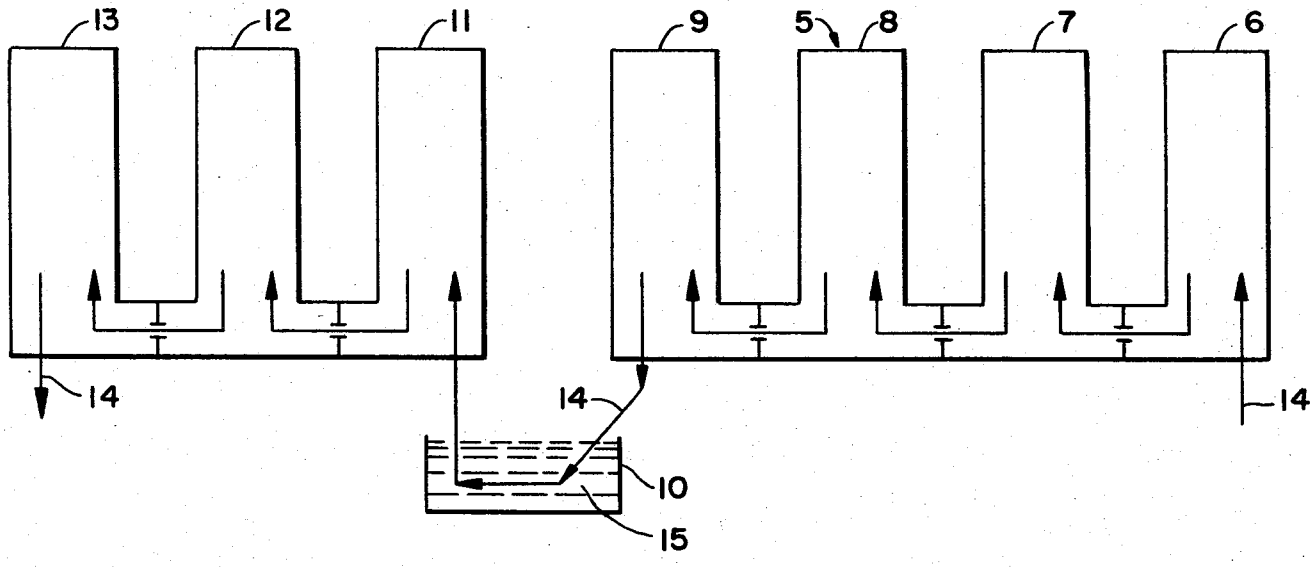
FIG. 1 is a schematic illustration of an annealing furnace, showing the various sections through which a continuous strip of metal is passed for treatment.

With reference to FIG. 1, there is shown an annealing furnace 5 which is designed for the production of high strength steels and which essentially comprises the strip temperature conditioning components of a preheating section 6, a heating section 7, a soaking section 8, a gas jet cooling section 9, a quenching apparatus 10, a reheating section 11, an overaging section 12, and a fast cooling section 13 through which a continuous sheet or strip 14 of metal, e.g. steel, successively travels for annealing. A protective gaseous atmosphere is provided in all of the sections, except the preheating section 6 to which hot exhaust gas from radiant heaters in either or both of the heating or soaking sections 7,8, is circulated to preheat the strip 14 of metal to a low temperature not exceeding 400° F. to prevent oxidation of the exposed surfaces of the strip 14 of metal. The protective gaseous atmosphere consists essentially of 92–98% nitrogen and correlated amounts of 8–2% hydrogen, by volume, depending upon the particular results desired.

Any suitable quenching liquid, e.g. water 15, is provided in the quenching apparatus 10 for contacting the continuous strip 14 of metal as it travels between the gas jet cooling section 9 and the reheating section 11.

INVENTION

Figure 3:
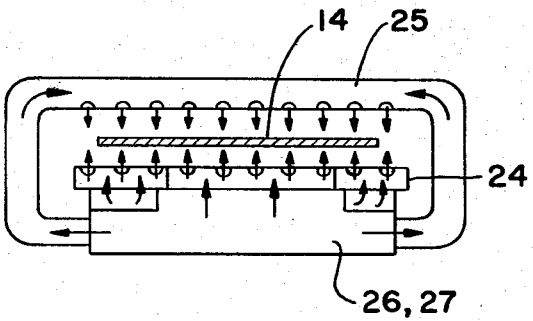
FIG. 3 is a cross-section of a plenum/nozzle arrangement that is used to impinge streams or jets of cooling gas against the strip of metal as it travels through the gas jet cooling section of the annealing furnace.
Figure 2:
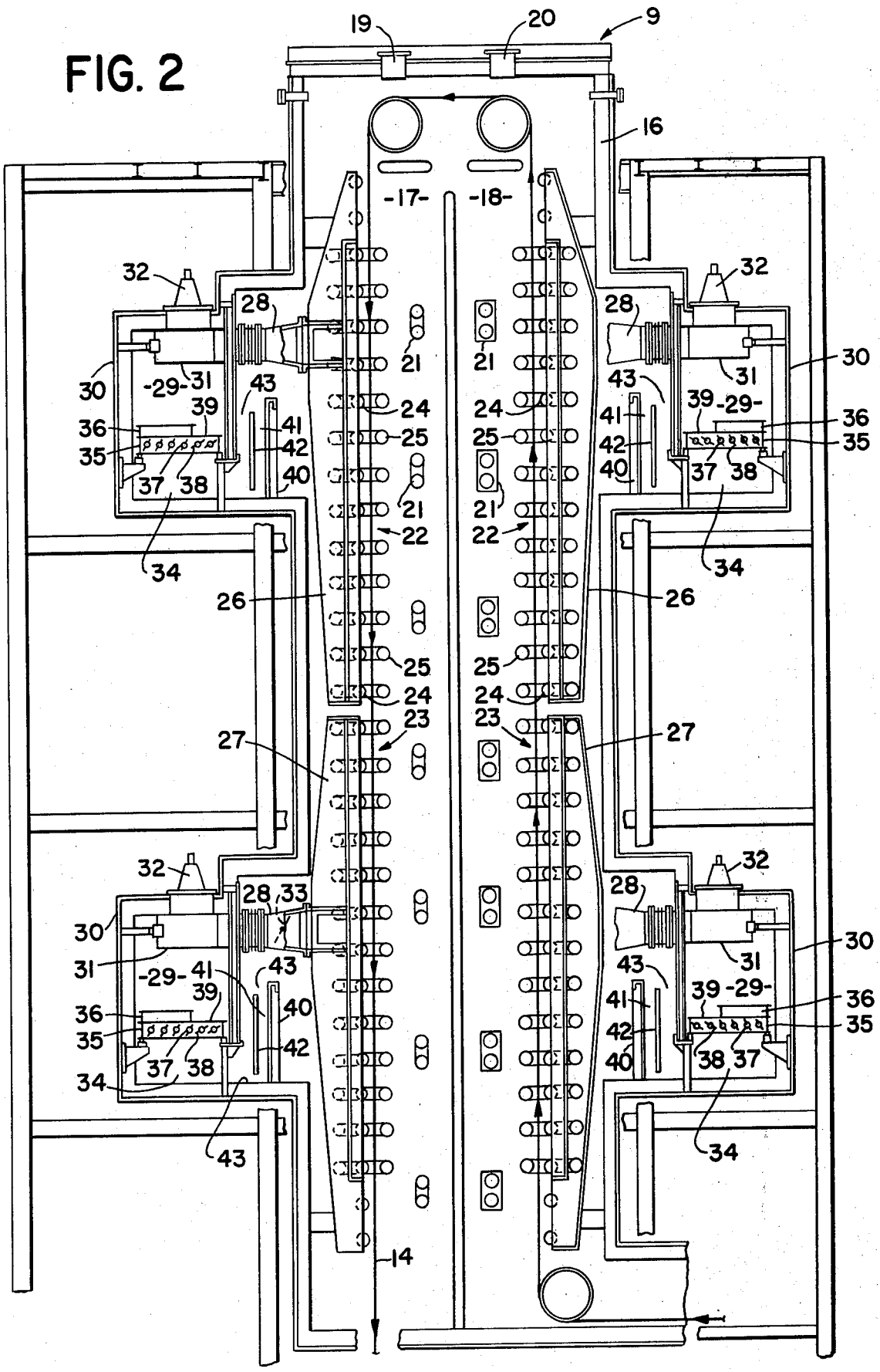
FIG. 2 is a schematic cross-section of a gas jet cooling section of the annealing furnace that is made in accordance with the invention.

With reference to FIGS. 2 and 3, the gas jet cooling section 9 essentially comprises an outer casing or housing 16 in which there are two vertically elongated and divided temperature conditioning chambers 17,18 through which the strip 14 of metal is vertically passed in alternate directions, primarily for cooling, prior to being quenched. The outer housing 16 is provided with any suitable means, e.g. gas inlet openings 19,20 and gas outlet openings (not shown), for allowing a protected gaseous atmosphere of nitrogen and hydrogen to be circulated to, and purged from , the chambers 17,18. Any appropriately designed radiant heaters 21 are provided in the chambers 17,18 for radiantly heating the gaseous atmosphere within the chambers 17,18 of the gas jet cooling section 9.

Two vertically elongated and spaced banks 22,23 of confronting pairs of nozzles 24,25 are provided in each of the chambers 17,18 for impinging streams or jets of cooling gas against the strip 14 of metal as it travels vertically between the horizontally spaced and aligned pairs of confronting nozzles 24,25. Specially tapered gas plenums 26,27 are used to circulate temperature conditioned gas to the nozzles 24,25 of each of the banks 22,23 of nozzles. The tapered plenums 26,27 are each connected to a horizontal supply duct 28 which extends laterally from a communicating plenum into an adjacent compartment 29 that is formed alongside the chambers 17,18 in four laterally offset wings 30 of the housing 16. The compartments 29 each have a vertically uppermost fluid outlet 31 through which gas exits the compartments 29 into the adjacent supply ducts 28 for subsequent direction to the plenums 26,27 and communicating pairs of confronting nozzles 24,25.

A variable speed fan or blower 32 is provided in each of the supply ducts 28 for drawing gas from the compartments 29 into the horizontal supply ducts 28 for circulation, under pressure, to the nozzles 24,25. The use of variable speed fans 32 to control the mass flow of gas through the plenums 26,27 and nozzles 24,25 is an improvement over the use of rotary dampers 33 (shown in dotted line) that are normally used in other gas jet cooling sections 9, since the variable speed fans 32 do not restrict the supply ducts 28 as a means of impeding and controlling the flow of gas to the plenums 26,27. The variable speed fans 32 provide a more uniformly regulated mass flow of gas through the supply ducts 28. A fluid inlet 34 is provided in the vertically lowermost portion of each compartment 29. A gas dampering louver 35 spans each fluid inlet 34, and a cooling device 36 is mounted atop each louver 35.

Each cooling device 36 essentially comprises a heat exchanger through which a cooling liquid, such as water, is continuously circulated for heat exchanging relation with hot gas entering the compartments 29 through the fluid inlets 34. Each louver 35 is provided with two sets 37,38 of rotary dampers which can be operated, in unison, to close the fluid inlets 34 through which gas enters the compartments 29. Each cooling device 36 is smaller, in area, than the adjacent, juxtaposed louver 35, so that there is formed in the louver 35, an opening 39 through which gas can bypass the cooling device 35 as it enters the compartments 29. The first set 37 of dampers are associated with the cooling device 36 and the second set 38 of dampers are associated with the bypass opening 39. By closing the second set 38 of dampers and opening the first set 37 of dampers, hot gas is forced to enter the compartments 29 via the cooling devices 36. By closing the first set 37 of dampers and opening the second set 38 of dampers, hot gas is forced to enter the compartments 29 via the bypass openings 39. The dampers can also be adjusted so that the heated gas entering the compartments 29 can be divided between the cooling devices 36 and bypass opening 39. In this manner, the temperature of the gas being impinged against the traveling strip 14 of metal can be adjusted to maintain or lower the temperature of the strip 14 of metal. The radiant heaters 21 can be operated to produce in the chambers 17,18, a heated gaseous atmosphere at a temperature which is higher than the temperature of the strip 14 of metal so that, in some cases, the strip 14 of metal can actually be heated by bypassing the cooling device 36 with hot gas, or by simply stopping operation of the fans 32.

It can be appreciated by those skilled in the art, that it is important to continuously circulate cool water through the cooling device 36. However, because of the rotary dampers of the louvers 35, it is practically impossible to seal the fluid inlet 34 of the compartments 29, so that there is usually a slight backflow of cooled gas from the compartments 29 through the cooling devices 36 to the chambers 17,18, especially when the variable speed fans 32 are not in operation. This escape of cool gas into the chambers 17,18, creates within the chambers, cold spots which adversely affect the uniformity of the temperature of the gaseous atmosphere within the chambers 17,18 and, consequently, the uniformity of the temperature of the gas being impinged from the nozzles, because of the closed loop gas circulation system employed in the gas jet cooling section 9. A certain amount of the hot gaseous atmospheres within the chamber 17,18 is lost as the strip 14 of metal enters and exits the gas jet cooling section 9, so that makeup protective gas is constantly circulated into the chambers 17,18 through the fluid inlet openings 19,20 of the chambers 17,18.

The backflow of cool gas into the chambers 17,18, is overcome by the provision in each laterally offset wing 30 of a vertically upright, solid, gas impervious wall-like baffle 40 which is in spaced relation from the closed compartments 29 closer the chambers 17,18. The vertically uppermost tops of the upright baffles 40 terminate in spaced vertical relation above the cooling devices 36 and, in effect, form with the walls and floors of the laterally offset wings 30, a cold sink around each of the cooling devices 36 to prevent the backflow of gas from the compartments 20 through the cooling devices 36 into the chambers 17,18. The baffles 40 are composed of any suitable material and act as gas impervious barriers to literally block the backflow of gas, cooled by the cooling devices 36, into the chambers to eliminate, or substantially reduce undesirable cold spots within the chambers to provide more uniform temperatures within the chambers, so that the gas cooling and heating systems can be operated more efficiently and effectively.

It can also be appreciated by those skilled in the art, that the vertical gas plenums 26,27 and horizontal supply ducts 28 are heated by the radiant heaters 21 and hot gaseous atmosphere within the chambers 17,18. It has been found that heat radiates downwardly from these gas pipes into the L-shaped fluid passageways 41 that are formed by the upright baffles 40 and lead to the fluid inlets 34 of the closed compartments 29. This heat radiation is undesirable and is substantially reduced by the provision of a vertically upright, divider wall 42 between each closed compartment 29 and adjacent baffle 40. The divider walls 42 are spaced above the floors 43 of the latterally offset wings 30 and effectively reduce the mouths 44 of the fluid passageways 41, which is critical, since the amount of heat radiating into each fluid passageway 41 is proportional to the size of the mouth of the fluid passageways.

Thus, there has been described a unique cooling section, wherein the temperature of a hot strip of metal can be maintained, or alternately cooled or heated for subsequent passage into a quenching tank. This flexible capability of temperature conditioning the strip of metal is highly advantageous and unlike existing units which are much more rigid and only capable of cooling the strip of metal, mainly by the circulation of a cooling gas or liquid through radiant tube heaters which are usually provided in the cooling sections of annealing furnaces. The undesirable backflow of cooling gas into the chambers normally encountered in other systems, is eliminated by the employment of a cold sink around the cooling device that is used in the cooling of the gas which is later impinged against the hot metal strip as it travels through the cooling section.

What is claimed:

1. In combination:

(a) a housing having a vertically elongated chamber sealed from the ambient atmosphere;
(b) means for passing a continuous element, to be cooled, vertically through the chamber;
(c) means for allowing gas in and out of the chamber;
(d) means disposed in the chamber for heating gas therein;
(e) means for impinging streams of cooling gas against the element as it passes vertically through the chamber;
(f) means disposed adjacent and in communicating relation with the chamber for removing heated gas from the chamber and cooling such gas as such gas passes in a forward direction through said cooling means, prior to the impingement of such cooling gas against the element; and
(g) means forming a gas impervious barrier between the chamber and the gas cooling means to prevent gas, cooled by passage through the gas cooling means in an opposite backward direction, from flowing into the chamber.

2. The combination of claim 1, wherein the gas removing and cooling means (f) includes:
(I) a heat exchanger;
(II) means for circulating a cooling liquid through the heat exchanger; and
(III) means for directing gas, to be cooled, through the heat exchanger into heat exchanging relationship with the cooling liquid circulating through the heat exchanger.

3. The combination of claim 2, wherein the gas removing and cooling means (f), includes:
(IV) means for bypassing the heat exchanger when the gas is adequately temperature conditioned for impingement against the element.

4. The combination of claim 3, wherein the gas removing and cooling means (f), the barrier forming means (g), and the gas directing means (III) include:
(V) a compartment aside the chamber and sealed therefrom, except for a horizontal fluid inlet in the vertically lowermost bottom thereof;
(VI) means for positioning the heat exchanger horizontally in the compartment in spaced vertical relation above the inlet opening, the heat exchanger being smaller than the inlet opening so that a bypass opening is formed;
(VII) two sets of independently operating rotary dampers disposed between the inlet opening and the heat exchanger and bypass opening, one set of dampers associated with the heat exchanger and regulating the flow of gas therethrough into the compartment, and the other set of dampers associated with the bypass opening and regulating the flow of gas therethrough into the compartment; and
(IV) a baffle vertically disposed between the first compartment and the chamber, the baffle terminating in spaced vertical relation above the heat exchanger and forming with the first compartment an angle-shaped fluid passageway which leads to the heat exchanger, the baffle being a gas impervious barrier designed to block the flow of gas from the chamber backwardly through the heat exchanger and fluid inlet into the chamber.

5. The combination of claim 4, which includes a divider wall positioned vertically in the fluid passageway between the compartment and the baffle to reduce the radiation of heat downwardly into the fluid passageway, the divider wall terminating in vertically spaced relation above the vertically lowermost point of the baffles.

6. The combination of claim 5, wherein the means (e) for impinging streams of cooling gas against the element, includes:
(I) a plurality of confronting nozzles for impinging streams of cooling gas against opposing sides of the element as the element moves through the chamber;
(II) a plenum for supplying cooling gas to the nozzles;
(III) means coacting between the plenum and gas cooling means for circulating, under pressure, cooled gas from the gas cooling means through the plenum to the nozzles; and
(IV) means for varying the flow of cooling gas through the plenum.

7. The combination of claim 6, wherein the means for circulating cooled gas through the plenum to the nozzles and the means for varying the flow of cooling gas through the plenum includes a variable speed fan and means for varying the speed at which the fan operates.

8. The combination of claim 7, which includes:
(h) means for heating the element, prior to entry of the element into the chamber; and
(i) means for quenching the element with a cooling liquid immediately after the element exits the chamber.

9. An annealing furnace, comprising a heating section, a soaking section and a cooling section through which a continuous strip of metal is successively passed, the cooling section including:
(a) a vertically elongated chamber having at least one pair of oppositely extending wings which project laterally from the chamber and which are defined by at least three sidewalls and a floor;
(b) means for directing a continuous strip of metal vertically through the chamber;
(c) a plurality of nozzles horizontally disposed on opposite sides of the strip of metal for impinging streams of gas against adjacent sides of the strip of metal;
(d) a pair of vertically disposed plenums communicating with the nozzles, the plenums positioned between the nozzles and the laterally extending wings, the plenums each including a communicating supply duct which extends horizontally into the closest adjacent wing and a compartment that is formed in the wing and sealed from the chamber, except for a fluid inlet through which gas from the chamber enters the compartment, the fluid inlet being spaced vertically above the floor of the wing in which the compartment is located, each compartment also having a fluid outlet through which gas passes from the compartment into an adjacent supply duct;
(e) a heat exchanger horizontally disposed in each compartment in spaced vertical relation above the fluid inlet, the heat exchanger being smaller, in size, than the fluid inlet so that a bypass opening is formed for allowing gas to enter the fluid inlet and bypass the heat exchanger as the gas moves into the compartment;
(f) means for continuously circulating cooling liquid through the heat exchanger during operation of the cooling section of the furnace;
(g) two sets of dampers positioned between the inlet opening and heat exchanger and bypass opening and capable of alternately (i) closing the inlet opening, (ii) allowing gas to enter the compartment via the inlet opening and heat exchanger where the gas is brought into heat exchanging relation with the cooling liquid circulating through the heat exchanger, and (iii) allowing gas to enter the compartment via the fluid inlet and bypass opening;

(h) a solid, gas impervious baffle extending vertically from the floor of each wing in horizontal spaced relation from the adjacent compartment formed in the wing, each baffle being closer the chamber than the adjacent compartment and terminating vertically above the heat exchanger in the adjacent compartment, the baffles forming with the compartments and floors and sidewalls of the wings, fluid passageways leading to the inlet openings in the compartments, the baffles also forming in each of the wings, a cold sink to prevent the backflow of gas from the compartment through the heat exchanger into the chamber; and (i) a fan coacting with each horizontal supply duct for drawing gas from the communicating compartment through the fluid inlet into the supply duct for circulation, under pressure to the plenum and communicating nozzles.

10. The annealing furnace of claim 9, which includes a divider wall vertically disposed in each of the fluid passageways and substantially reduce the radiation of heat into the fluid passageways, the divider walls terminating in spaced vertical relation above the floors of the wings.

11. The annealing furnace of claim 10, which includes a plurality of radiant heaters disposed in the chamber for heating gas therein.

12. The annealing furnace of claim 11, which includes a tank containing a quenching liquid, and means for directing the strip of metal into the quenching liquid immediately after the strip of metal exits the chamber of the cooling section.

13. The annealing furnace of claims 9, 11 or 12 which includes means for varying the speed of the fan and consequent flow of gas through the supply ducts.

* * * * *